US006510702B2

(12) United States Patent
Suitou et al.

(10) Patent No.: US 6,510,702 B2
(45) Date of Patent: Jan. 28, 2003

(54) CONTROL VALVE FOR VARIABLE DISPLACEMENT COMPRESSOR

(75) Inventors: Ken Suitou, Kariya (JP); Kazuya Kimura, Kariya (JP); Masaki Ota, Kariya (JP); Ryo Matsubara, Kariya (JP); Taku Adaniya, Kariya (JP); Yoshikazu Fukutani, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 64 days.

(21) Appl. No.: 09/836,402

(22) Filed: Apr. 17, 2001

(65) Prior Publication Data

US 2001/0029742 A1 Oct. 18, 2001

(30) Foreign Application Priority Data

Apr. 18, 2000 (JP) ..... 2000-116426

(51) Int. Cl.[7] ..... F25B 1/00; F04B 1/26
(52) U.S. Cl. ..... 62/228.3; 417/222.2
(58) Field of Search ..... 62/228.5, 228.3; 417/222.2, 270

(56) References Cited

U.S. PATENT DOCUMENTS 6,102,668 A 8/2000 Kawaguchi et al. ..... 417/222.2
6,385,979 B2 * 5/2002 Ota et al. ..... 62/133 X
6,385,982 B1 * 5/2002 Ota et al. ..... 62/229 X
6,412,294 B2 * 7/2002 Kimura et al. ..... 62/228.3
6,434,956 B1 * 8/2002 Ota et al. ..... 417/222.2 X

* cited by examiner

*Primary Examiner*—William Wayner
(74) *Attorney, Agent, or Firm*—Morgan & Finnegan, LLP

(57) ABSTRACT

A control valve includes a valve chamber. A valve body is located in the valve chamber. A first regulator regulates the movement of the valve body. A first spring urges the valve body towards the first regulator. A sensing member divides a sensing chamber into a first pressure chamber and a second pressure chamber. The sensing member moves in accordance with the pressure difference. A regulator surface regulates the movement of the sensing member. A temporary chamber is formed between the sensing member and the valve body when the valve body is disconnected from the sensing member. The temporary chamber is connected to the second pressure chamber. A second spring urges the sensing member toward the regulator surface. An actuator applies a force to the valve body that is opposite to the force of the first spring and that of the second spring in accordance with commands from an external controller.

13 Claims, 7 Drawing Sheets

CONTROL VALVE FOR VARIABLE DISPLACEMENT COMPRESSOR

BACKGROUND OF THE INVENTION

The present invention relates to a control valve for use in a variable displacement compressor.

Generally, vehicle air conditioners include a condenser, an expansion valve, as a depressurizing device, an evaporator, and a compressor. The compressor draws refrigerant gas from the evaporator, compresses it, and then discharges the compressed gas to the condenser. The evaporator transfers heat between the refrigerant flowing in the refrigerant circuit and air in the vehicle. In accordance with the cooling load, the heat of air passing near the evaporator is transferred to the refrigerant flowing in the evaporator. The pressure of the refrigerant gas in the vicinity of the outlet of the evaporator reflects the cooling load.

A swash plate type variable displacement compressor for such an air conditioner is provided with a displacement control system for steering the pressure (suction pressure Ps) near the outlet of the evaporator to a predetermined suction pressure. The displacement control system controls the discharge displacement of the compressor, i.e., the inclination angle of its swash plate, to obtain a flow rate corresponding to the cooling load.

In the control process, a pressure sensing member such as a bellows or a diaphragm, senses the suction pressure Ps. In accordance with the displacement of the pressure sensing member, the valve opening is controlled to regulate the pressure in a crank chamber (crank pressure Pc).

A simple control valve that imposes a single target suction pressure cannot control the air conditioning performance accurately. Therefore, an electromagnetic control valve that changes the target suction pressure in accordance with an external current has been proposed. Such a control valve includes an actuator such as a solenoid. A force acting on the sensing member is changed in accordance with the current to the actuator. Accordingly, the target suction pressure is adjusted.

According to the above-described control method, however, even if the target suction pressure is changed by electric control, the actual suction pressure may not reach the target suction pressure. That is, the cooling load is likely to affect whether or not the actual suction pressure responds well to changes in the target suction pressure. It is not therefore possible to promptly and reliably alter the displacement of a compressor even if the actual suction pressure is regulated as needed by electric control.

SUMMARY OF THE INVENTION

It is an object of the present invention to provide a control valve for a variable displacement compressor that changes the displacement of the compressor quickly and reliably.

To achieve the above objective, the present invention provides a control valve used for a variable displacement compressor in a refrigerant circuit. The compressor changes the displacement in accordance with the pressure in a crank chamber and includes a supply passage, which connects a discharge pressure zone to the crank chamber, and a bleed passage, which connects a suction pressure zone to the crank chamber. The control valve comprises a valve housing. A valve chamber is defined in the valve housing. The valve chamber is part of the supply passage or the bleed passage. A movable valve body is located in the valve chamber. The valve body adjusts an opening size of the supply passage or the bleed passage in the valve chamber. A valve body regulator regulates the movement of the valve body. A first urging member urges the valve body towards the valve body regulator. A sensing chamber is defined in the valve housing. A sensing member is located in the sensing chamber to divide the sensing chamber into a first pressure chamber and a second pressure chamber. The sensing member engages with and disengages from the valve body. The pressure of a first pressure monitoring point located in the refrigerant circuit is applied to the first pressure chamber. The pressure of a second pressure monitoring point located in the refrigerant circuit is applied to the second pressure chamber. The sensing member moves in accordance with the pressure difference between the first pressure chamber and the second pressure chamber. A sensing member regulator regulates the movement of the sensing member. The sensing member regulator is located in the second pressure chamber. A temporary chamber is formed between the sensing member and the valve body when the valve body is disconnected from the sensing member. The temporary chamber is connected to the second pressure chamber. A second urging member urges the sensing member toward the sensing member regulator. An actuator applies a force to the valve body that is opposite to the force of the first urging member and that of the second urging member in accordance with commands from an external controller. The actuator changes a target pressure difference, which is a reference value for the operation of the sensing member.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which:

FIG. 4(*b*) is an enlarged partial sectional view of the control valve when the operating rod is in a predetermined position;

FIG. 4(*c*) is an enlarged partial sectional view of the control valve when the operating rod is in the uppermost position;

DETAILED DESCRIPTION OF THE PREFERRED EMBODIMENTS

A control valve used in a swash plate type variable displacement compressor incorporated in the refrigerant circuit of a vehicle air conditioner will be described with reference to FIGS. 1 to 6.

Figure 1:
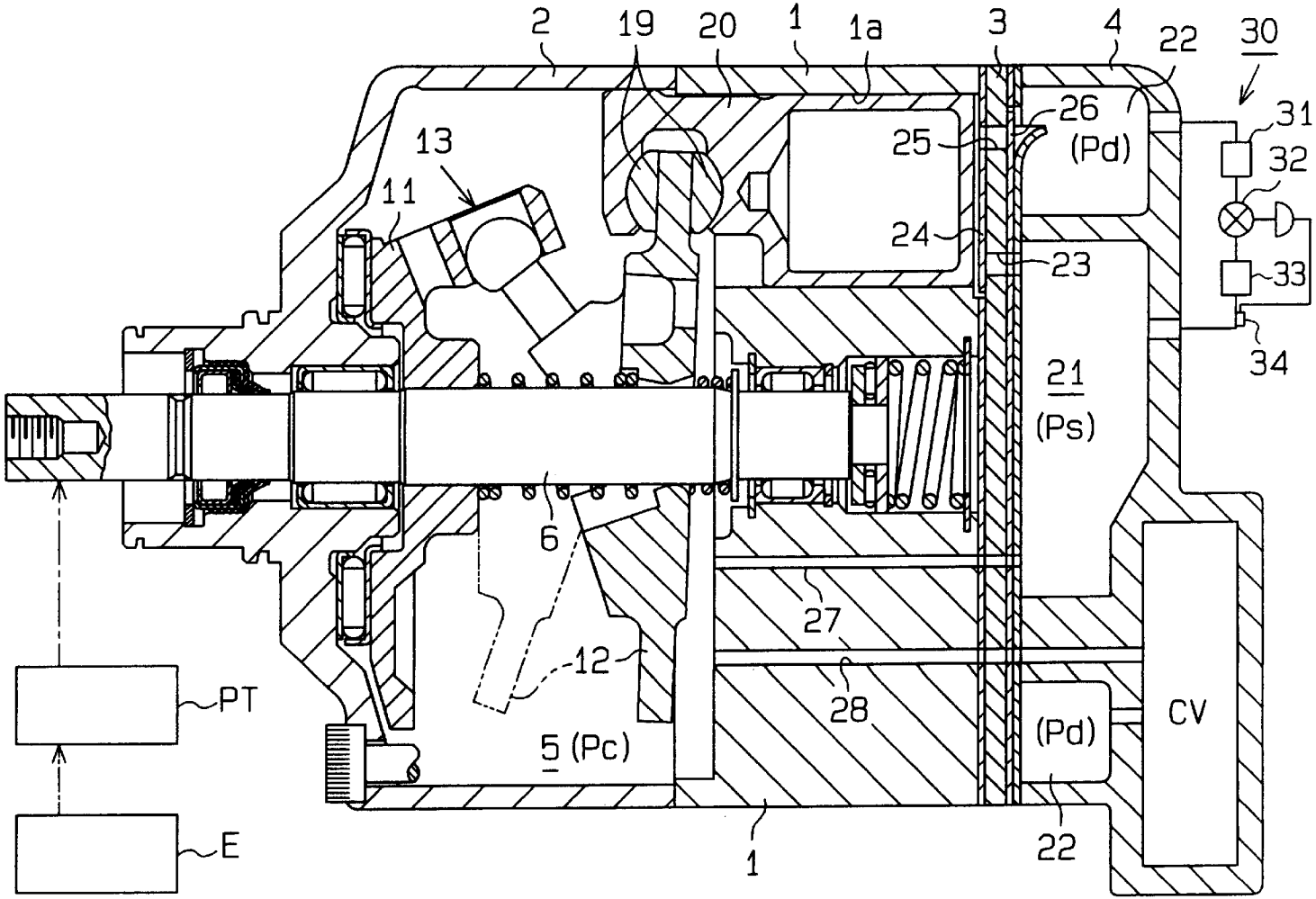
FIG. 1 is a sectional view of a swash plate type variable displacement compressor according to first embodiment of the present invention.

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1.

A crank chamber 5 is defined between the cylinder block 1 and the front housing member 2. A drive shaft 6 is supported in the crank chamber 5 by bearings. A lug plate 11 is fixed to the drive shaft 6 in the crank chamber 5 to rotate integrally with the drive shaft 6.

The front end of the drive shaft 6 is connected to an external drive source, which is an engine E in this embodiment, through a power transmission mechanism PT. In this embodiment, the power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Formed in the cylinder block 1 are cylinder bores 1*a* (only one is shown in FIG. 1) at constant angular intervals around the drive shaft 6. Each cylinder bore 1*a* accommodates a single headed piston 20 such that the piston can reciprocate in the bore 1*a*. In each bore 1*a* is a compression chamber, the displacement of which varies in accordance with the reciprocation of the piston 20. The front end of each piston 20 is connected to the periphery of the swash plate 12 through a pair of shoes 19. As a result, the rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore 1*a*, a suction port 23, a suction valve 24 for opening and closing the suction port 23, a discharge port 25, and a discharge valve 26 for opening and closing the discharge port 25. The suction chamber 21 communicates with each cylinder bore 1*a* through the corresponding suction port 23, and each cylinder bore 1*a* communicates with the discharge chamber 22 through the corresponding discharge port 25.

When the piston 20 in a cylinder bore 1*a* moves from its top dead center to position its bottom dead center position, the refrigerant gas in the suction chamber 21 flows into the cylinder bore 1*a* through the corresponding suction port 23 and the corresponding suction valve 24. When the piston 20 moves from its bottom dead center position toward its top dead center position, the refrigerant gas in the cylinder bore 1*a* is compressed to a predetermined pressure, and it forces the corresponding discharge valve 26 to open. The refrigerant gas is then discharged through the corresponding discharge port 25 and the corresponding discharge valve 26 into the discharge chamber 22.

The inclination angle of the swash plate 12 (the angle between the swash plate 12 and a plane perpendicular to the axis of the drive shaft 6) is determined on the basis of various moments such as the moment of rotation caused by the centrifugal force upon rotation of the swash plate, the moment of inertia based on the reciprocation of the piston 20, and a moment due to the gas pressure. The moment due to the gas pressure is based on the relationship between the pressure in the cylinder bores 1*a* and the crank pressure Pc. The moment due to the gas pressure increases or decreases the inclination angle of the swash plate 12 in accordance with the crank pressure Pc.

In this embodiment, the moment due to the gas pressure is changed by controlling the crank pressure Pc with a displacement control valve CV. The inclination angle of the swash plate 12 can be changed to an arbitrary angle between the minimum inclination angle (shown by a solid line in FIG. 1) and the maximum inclination angle (shown by a broken line in FIG. 1).

Figure 2:
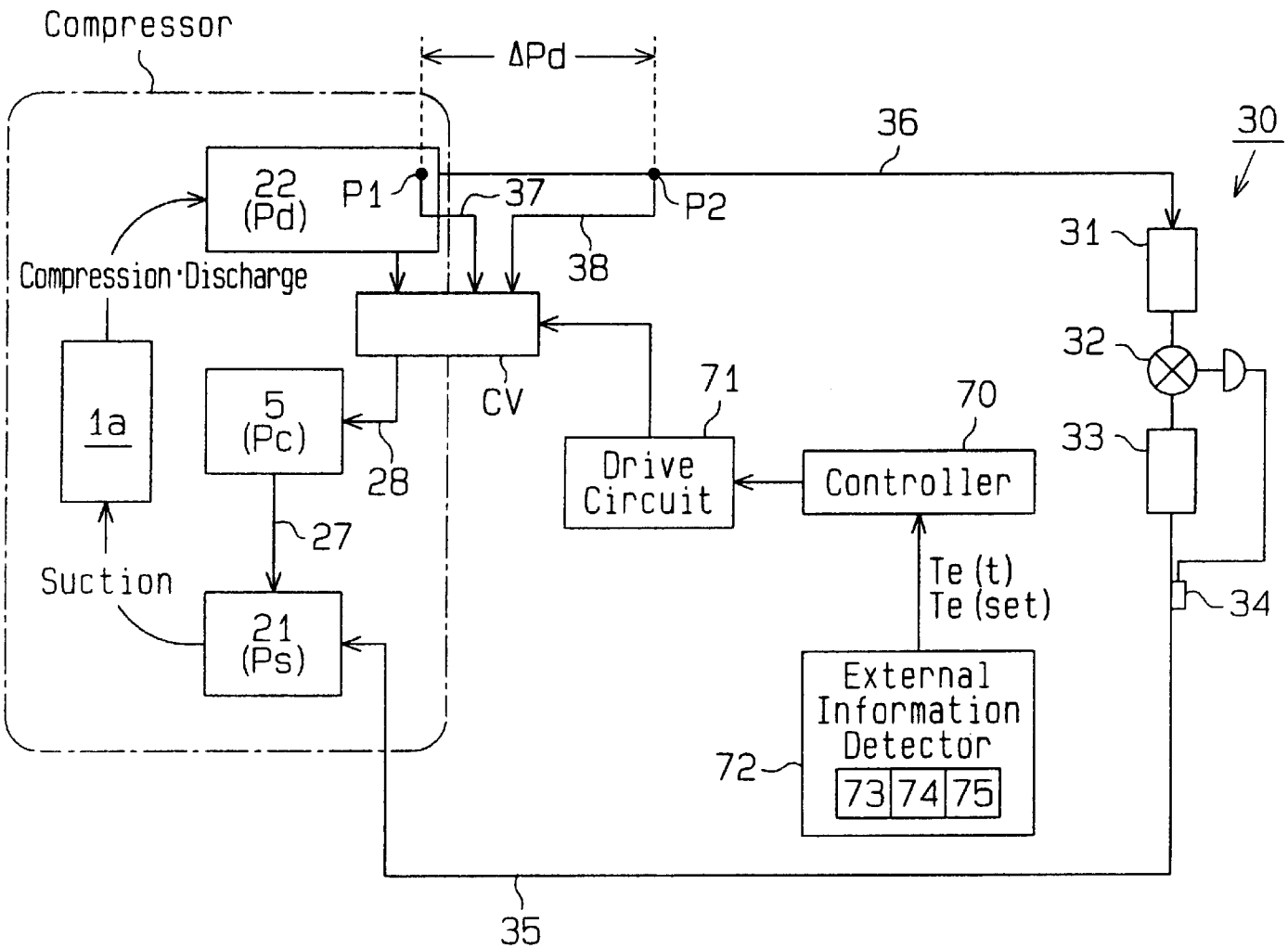
FIG. 2 is a circuit diagram schematically showing a refrigerant circuit according to the present embodiment.

As shown in FIGS. 1 and 2, a control mechanism for controlling the crank pressure Pc is comprised of a bleed passage 27, a supply passage 28, and a displacement control valve CV. The bleed passage 27 connects the suction chamber 21 and the crank chamber 5. The supply passage 28 is for connecting the discharge chamber 22 and the crank chamber 5. The displacement control valve CV is provided midway along the supply passage 28.

The displacement control valve CV changes the opening size of the supply passage 28 to control the flow rate of refrigerant gas flowing from the discharge chamber 22 to the crank chamber 5. The pressure in the crank chamber 5 is changed in accordance with the relation between the flow rate of refrigerant gas flowing from the discharge chamber 22 into the crank chamber 5 and the flow rate of refrigerant gas flowing out from the crank chamber 5 through the bleed passage 27 into the suction chamber 21. In accordance with changes in the crank pressure Pc, the difference between the crank pressure Pc and the pressure in the cylinder bores 1*a* varies to change the inclination angle of the swash plate 12. As a result, the stroke of the pistons 20 is changed to control the discharge displacement.

As shown in FIGS. 1 and 2, the refrigerant circuit of the vehicle air conditioner includes the compressor and an external refrigerant circuit 30. The external refrigerant circuit 30 includes, for example, a condenser 31, an expansion valve 32, and an evaporator 33. The opening of the expansion valve 32 is feedback-controlled on the basis of the temperature detected by a temperature sensing tube 34 provided near the outlet of the evaporator 33. The expansion valve 32 supplies a quantity of refrigerant corresponding to the thermal load to control the flow rate.

In the downstream part of the external refrigerant circuit 30, a flow pipe 35 is provided to connect the outlet of the evaporator 33 with the suction chamber 21. In the upstream part of the external refrigerant circuit 30, a flow pipe 36 is provided to connect the discharge chamber 22 of the compressor with the inlet of the condenser 31. The compressor draws refrigerant gas from the downstream side of the external refrigerant circuit 30, compresses the gas, and then discharges the compressed gas to the upstream side of the external refrigerant circuit 30.

The larger the displacement of the compressor is and the higher the flow rate of the refrigerant flowing in the external refrigerant circuit 30 is, the greater the pressure loss per unit length of the circuit, or piping. More specifically, the pressure loss between two points in the external refrigerant circuit correlates with the flow rate of the external refrigerant circuit 30. In this embodiment, defecting the difference in pressure ΔP(t)=PdH−PdL between two pressure monitoring points P1 and P2 indirectly detects the discharge displacement of the compressor. An increase in the discharge displacement of the compressor increases the flow rate of the refrigerant in the refrigerant circuit, and a decrease in the discharge displacement of the compressor decreases the flow rate of the refrigerant. Thus, the flow rate of the refrigerant in the external refrigerant circuit 30, i.e., the pressure difference ΔPd between the two points, reflects the discharge displacement of the compressor.

In this embodiment, an upstream, or first, pressure monitoring point P1 is located in the discharge chamber 22, and a downstream, or second, pressure monitoring point P2 is set midway along the flow pipe 36 at a position separated from the first pressure monitoring point P1 by a predetermined distance. The gas pressure PdH at the first pressure monitoring point P1 and the gas pressure PdL at the second pressure monitoring point P2 are applied respectively through first and second pressure detecting passages 37 and 38 to the displacement control valve CV.

Figure 3:
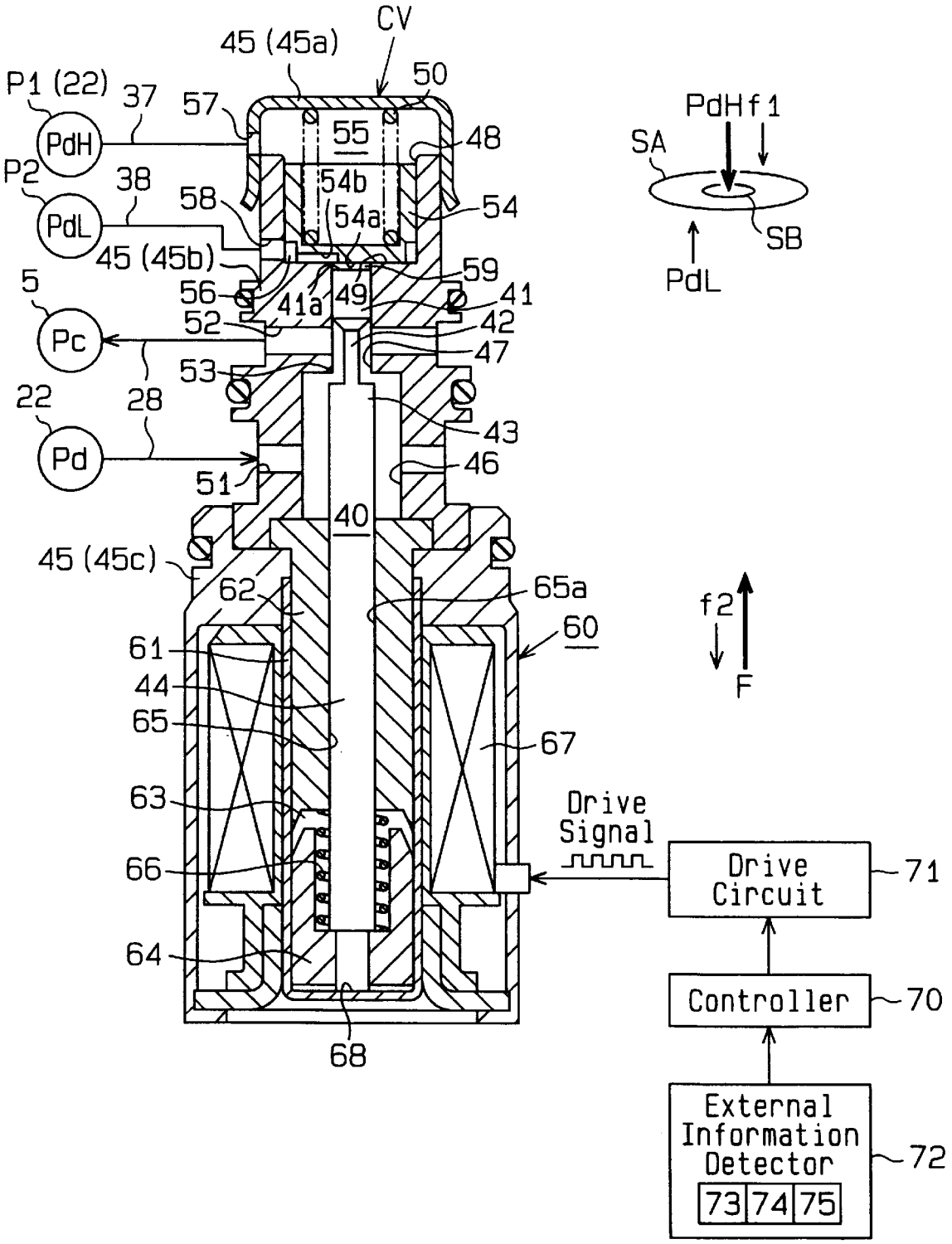
FIG. 3 is a sectional view of a control valve provided in the compressor of FIG. 1.

As shown in FIG. 3, the control valve CV is provided with an inlet valve portion and a solenoid 60. The inlet valve portion controls the opening of the supply passage 28 connecting the discharge chamber 22 with the crank chamber 5. The solenoid 60 serves as an electromagnetic actuator for controlling a rod 40 located in the control valve CV on the basis of an externally supplied electric current. The rod 40 has a distal end portion 41, a valve body 43, a connecting portion 42, which connects the distal end portion 41 and the valve body 43 with each other, and a guide 44. The valve body 43 is part of the guide 44.

A valve housing 45 of the control valve CV has a cap 45*a*, an upper half body 45*b*, and a lower half body 45*c*. Defined in the upper half body 45*b* are a valve chamber 46 and a communication passage 47. The upper half body 45*b* and the cap 45*a* define a pressure sensing chamber 48.

The rod 40 moves in the axial direction of the control valve CV in the valve chamber 46. The rod 40 passes through the communication passage 47 and the pressure sensing chamber 48. The valve chamber 46 is selectively connected to and disconnected from the passage 47 in accordance with the position of the rod 40. The communication passage 47 is separated from the pressure sensing chamber 48 by the distal end portion 41 of the rod 40.

The bottom wall of the valve chamber 46 is formed by the upper end surface of a fixed iron core 62. A first radial port 51 allows the valve chamber 46 to communicate with the discharge chamber 22 through an upstream part of the supply passage 28. A second radial port 52 allows the communication passage 47 to communicate with the crank chamber 5 through a downstream part of the supply passage 28. Thus, the first port 51, the valve chamber 46, the communication passage 47, and the second port 52 form a control passage part of the supply passage 28 for allowing the discharge chamber 22 to communicate with the crank chamber 5.

The valve body 43 of the rod 40 is located in the valve chamber 46. The inner diameter of the communication passage 47 is larger than the diameter of the connecting portion 42 of the rod 40 and is smaller than the diameter of the guide 44. That is, the opening area SB of the communication passage 47 (the cross sectional area of the distal end portion 41) is larger than the cross sectional area of the connecting portion 42 and smaller than the cross sectional area of the guide 44. A valve seat 53 is formed at the opening of the communication passage 47 (around the valve hole).

Figure 4A:
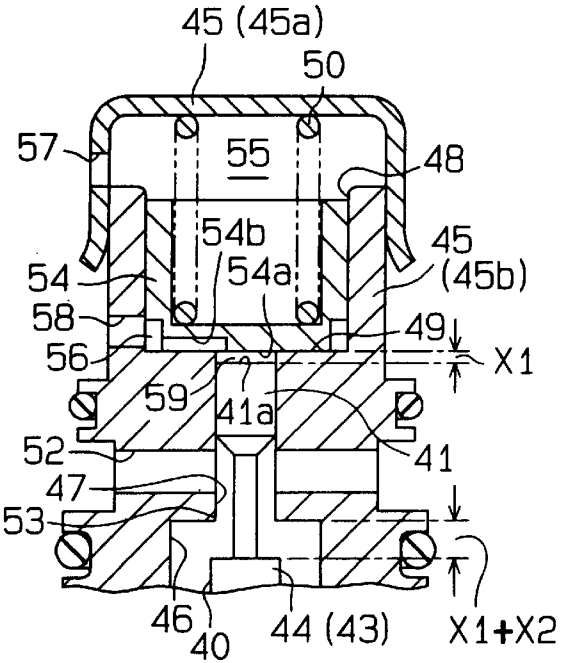
FIG. 4(*a*) is an enlarged partial sectional view of the control valve when its operating rod is in the lowermost position.
Figure 4B:
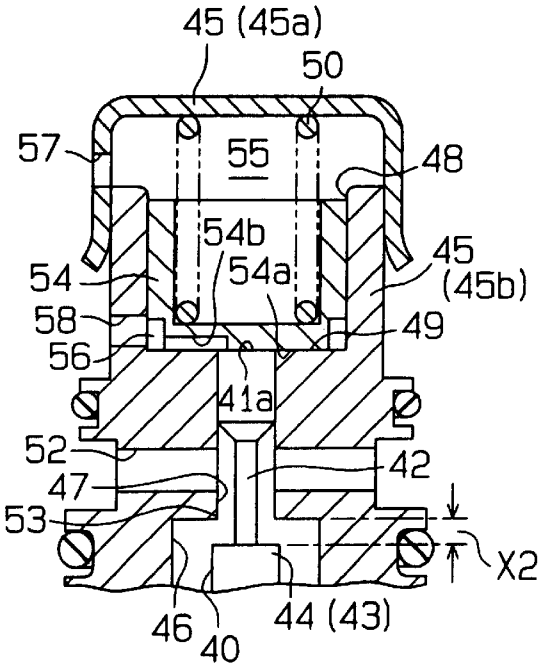
Figure 4C:
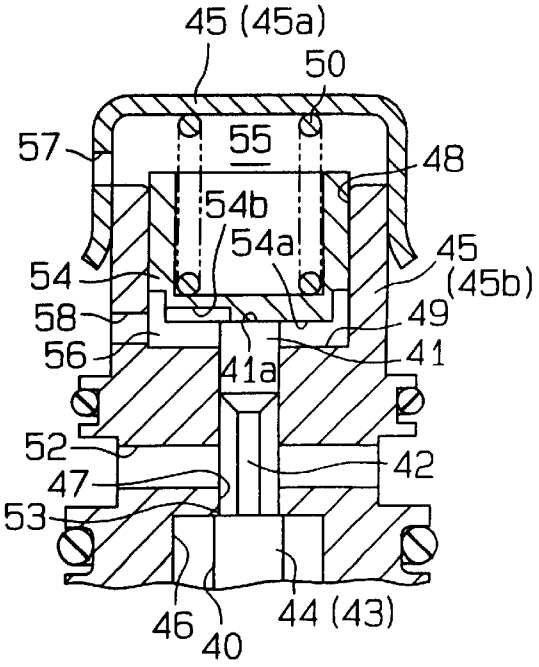

When the rod 40 moves from the lowest position shown in FIGS. 3 and 4(*a*) to the highest position shown in FIG. 4(*c*), at which the valve body 43 contacts the valve seat 53, the communication passage 47 is cut off. Thus, the valve body 43 of the rod 40 serves as an inlet valve body capable of controlling the opening of the supply passage 28.

A movable, cylindrical pressure sensing member 54 is located in the pressure sensing chamber 48. The pressure sensing member 54 divides the pressure sensing chamber 48 into two parts: a first pressure chamber 55 and a second pressure chamber 56. The pressure sensing member 54 serves as a partition separating the chambers 55 and 56 from each other and cutting off communication between the chambers 55 and 56. The cross sectional area SA of the pressure sensing member 54 is larger than the opening area SB of the communication passage 47.

When the pressure sensing member 54 moves downward, the lower surface 54*a* of the pressure sensing member 54 contacts the bottom surface of the second pressure chamber 56. The downward movement of the pressure sensing member 54 is then stopped by the bottom surface of the second pressure chamber 56. Thus, the bottom surface of the second pressure chamber 56 serves as a first regulation surface 49. As shown in FIG. 4(*a*), when the pressure sensing member 54 is in contact with the first regulation surface 49, a majority of the opening area of the communication passage 47 is covered with the lower surface 54*a* of the pressure sensing member 54.

The bottom wall of the pressure sensing member 54 is stepped. When the pressure sensing member 54 contacts the first regulation surface 49, the second pressure chamber 56, which is between the bottom wall of the pressure sensing member 54 and the inner circumferential surface of the pressure sensing chamber 48, is ring-shaped and is minimized.

A releasing groove 54*b* is formed in a lower portion of the pressure sensing member 54. The groove 54*b* extends radially of the control valve CV. Since the releasing groove 54*b* is provided, the opening of the communication passage 47 is not completely closed even when the pressure sensing member 54 contacts the first regulation surface 49.

In the first pressure chamber 55 is a first spring 50, which is a coil spring in this embodiment. The first spring 50 urges the pressure sensing member 54 toward the second pressure chamber 56, i.e., toward the first regulation surface 49.

The first pressure chamber 55 communicates with the discharge chamber 22, and the first pressure monitoring point P1, through a third port 57 formed in the cap 45*a* and through the first pressure detecting passage 37. The second pressure chamber 56 communicates with the second pressure monitoring point P2 through a fourth port 58 formed in the upper half body 45*b* of the valve housing 45 and through the second pressure detecting passage 38. Therefore, the discharge pressure Pd is applied as the first pressure PdH into the first pressure chamber 55, and the second pressure PdL of the pressure monitoring point P2 in the middle of the piping is applied to the second pressure chamber 56.

The solenoid 60 includes an accommodation tube 61, which is cylindrical and has a bottom. A fixed iron core 62 is fitted in the upper part of the accommodation tube 61. In the accommodation tube 61 is a solenoid chamber 63. A movable iron core 64 is accommodated to move axially in the solenoid chamber 63. An axially extending guide hole 65 is formed in the central portion of the fixed iron core 62. The guide 44 of the rod 40 is located to move axially in the guide hole 65.

The proximal end of the rod 40 is accommodated in the solenoid chamber 63. More specifically, the lower end of the guide 44 is fitted in a hole formed at the center of the movable iron core 64,and fixed by crimping. Thus, the movable iron core 64 and the rod 40 move integrally and axially.

The lower end portion of the guide 44 projects downward from the lower surface of the movable iron core 64. The downward movement of the rod 40 (the valve body 43) is stopped when the lower end surface of the guide 44 contacts the bottom surface of the solenoid chamber 63. That is, the bottom surface of the solenoid chamber 63 serves as a second regulation surface 68. The second regulation surface 68 prevents the rod 40 (the valve body 43) from moving downward to limit the opening of the communication passage 47.

A second spring 66 is accommodated between the fixed and movable iron cores 62 and 64 in the solenoid chamber 63. The second spring 66 urges the movable iron core 64 away from the fixed iron core 62. The second spring 66 urges the rod 40 (the valve body 43) downward, i.e., toward the second regulation surface 68.

As shown in FIGS. 3 and 4(*a*), when the rod 40 is at its lowest position, at which the rod 40 contacts the second regulation surface 68, the valve body 43 is separated from the valve seat 53 by distance X1+X2, and the opening of the communication passage is maximized. In this state, the distal end portion 41 of the rod 40 sinks into the communication passage 47 by distance X1 relative to the pressure sensing chamber 48. Accordingly, the distal end surface 41*a* of the distal end portion 41 is separated from the lower surface 54*a* of the pressure sensing member 54, which is in contact with the first regulation surface 49 by distance X1, and a space 59, which is defined by the two surfaces 41*a* and 54*a*, is formed in the communication passage 47. However, since the releasing groove 54*b* is formed near the space 59, the space 59 is connected to the second pressure chamber 56.

A coil 67 is wound about the fixed and movable iron cores 62 and 64. The coil 67 is supplied with a drive signal from a drive circuit 71 based on an instruction from a controller 70. The coil 67 generates an electromagnetic force F corresponding to an externally supplied electric current between the fixed and movable iron cores 62 and 64. The electric current supplied to the coil 67 is controlled by controlling the voltage applied to the coil 67. This embodiment employs duty control for controlling the applied voltage.

The position of the rod 40 in the control valve CV, i.e., the valve opening of the control valve CV, is determined as follows. In this case, the influence of the pressure of the valve chamber 46, the communication passage 47, and the solenoid chamber 63 on the position of the rod 40 is ignored.

As shown in FIGS. 3 and 4(*a*), when no current is supplied to the coil 67 (Dt=0%), the downward force f2 of the second spring 66 is dominant. As a result, the rod 40 is moved to its lowermost position and the force f2 of the second spring 66 presses the rod 40 against the second regulation surface 68. The force f2 by the second spring 66 at this time is the force f2' such that, for example, even when the compressor (the control valve CV) is vibrated by vibration of the vehicle, the rod 40 and the movable iron core 64 are pressed against the second regulation surface 68 and thus resist vibration.

In this state, the valve body 43 is separated from the valve seat 53 by distance X1+X2. As a result, the communication passage is fully open. Thus the crank pressure Pc is maximized, and the difference between the crank pressure Pc and the pressure in the cylinder bore 1*a* is relatively high. As a result, the inclination angle of the swash plate 12 is minimized, and the discharge displacement of the compressor is also minimized.

When the rod 40 is at its lowermost position, the rod 40 (the distal end portion 41) is disengaged from the pressure sensing member 54. Thus, for positioning of the pressure sensing member 54, the total load of the downward force (PdH·SA−PdL(SA−SB)) based on the pressure difference ΔPd between the two points and the downward force f1 of the first spring 50 is dominant. Thus the pressure sensing member 54 is pressed against the first regulation surface 49 by the total load. At this time the force f1 by the first spring 50 is f1' such that, e.g., even when the compressor (the control valve CV) is vibrated by vibration of the vehicle, the pressure sensing member 54 is pressed against the first regulation surface 49 to resist vibration.

In the state shown in FIGS. 3 and 4(*a*), when the electric current corresponding to the minimum duty ratio Dt(min) (Dt(min)>0) within the range of duty ratios is supplied to the coil 67, the upward electromagnetic force F exceeds the downward force f2 (f2=f2') of the second spring 66, and the rod 40 moves upward.

Figure 5:
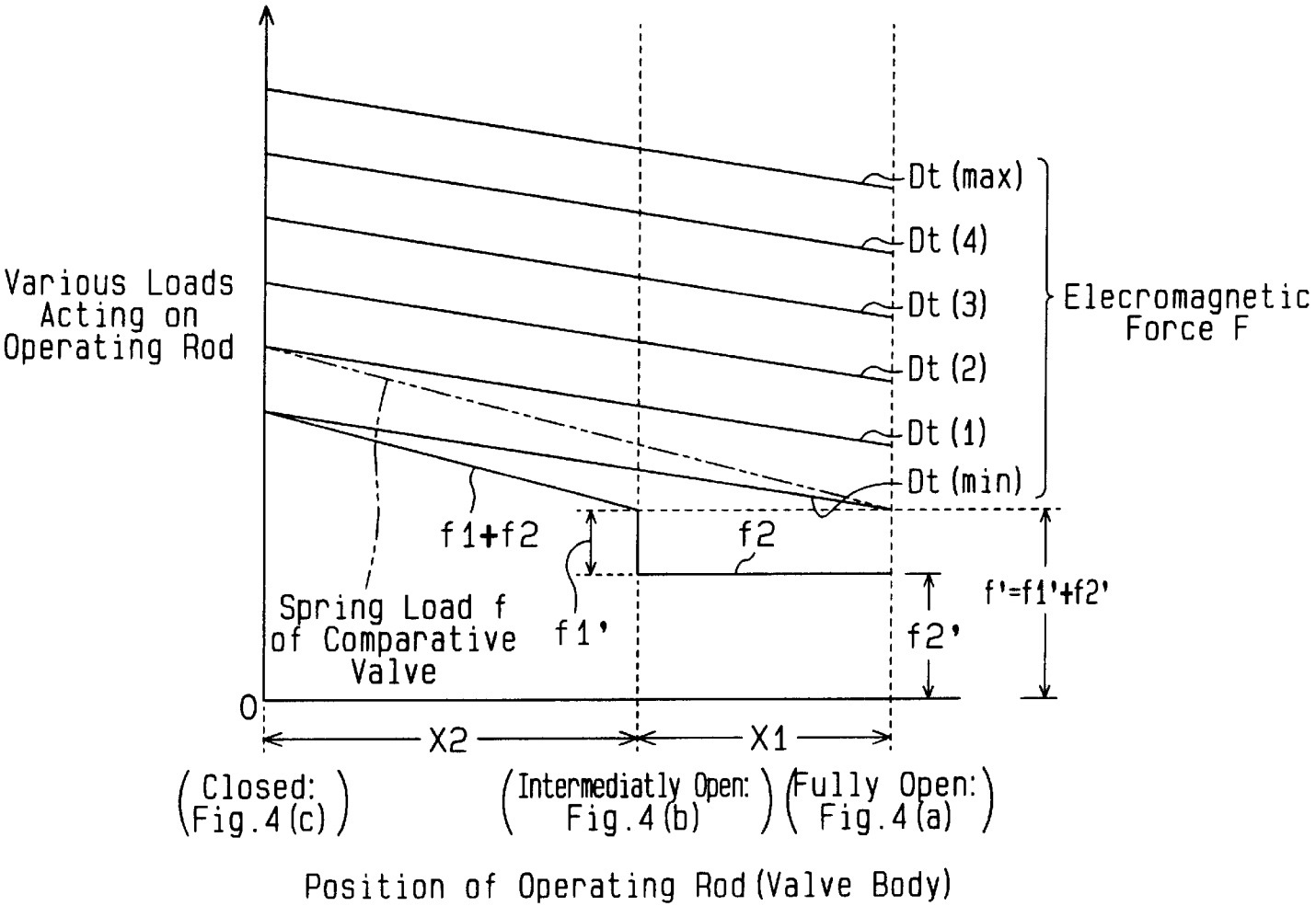
FIG. 5 is a graph showing relationships between the position of the operating rod and various loads acting on the rod.

The graph of FIG. 5 shows relationships between the position of the rod 40 (valve body 43) and various loads acting on the rod 40. When the duty ratio Dt of the electric current supplied to the coil 67 is increased, the electromagnetic force F acting on the rod 40 is increased accordingly. When the rod 40 moves upward to close the valve, since the movable iron core 64 is near to the fixed iron core 62, the electromagnetic force F acting on the rod 40 is increased even if the duty ratio Dt is not changed.

Actually, the duty ratio Dt of electric current supplied to the coil 67 is continuously variable between the minimum duty ratio Dt(min) and the maximum duty ration Dt(max) (e.g., 100%) within the range of duty ratios. For ease of understanding, the graph of FIG. 5 only shows cases of Dt(min), Dt(1) to Dt(4), and Dt(max).

As apparent from the inclinations of the characteristic lines f1+f2 and f2, the spring constant of the second spring 66 is far smaller than that of the first spring 50. The spring constant of the second spring 66 is such that the force f2 acting on the rod 40 is substantially the same as the load f2' regardless degree to which the second spring 66 is compressed.

When an electric current that is more than the minimum duty ratio Dt(min) is supplied to the coil 67, the rod 40 moves upward from the lowest position by at least distance X1. As a result, the distal end surface 41*a* of the distal end portion 41 reduces the volume of the space 59, and the distal end surface 41*a* comes into contact with the lower surface 54*a* of the pressure sensing member 54.

When the rod 40 contacts the pressure sensing member 54, the upward electromagnetic force F, which is connected by the downward force f2 of the second spring 66, is opposed to the downward force based on the pressure difference ΔPd between the two points, which adds to the downward urging force f1 of the first spring 50. Thus the valve body 43 of the rod 40 is positioned relative to the valve seat 53 between the state shown in FIG. 4(*b*) and the state shown in FIG. 4(*c*) to satisfy the following equation:

$$PdH \cdot SA - PdL(SA - SB) = F - f1 - f2 \quad (1)$$

The valve opening of the control valve CV is positioned between the middle open state of FIG. 4(*b*) and the full open state of FIG. 4(*c*). Thus, the discharge displacement of the compressor is varied between the minimum and the maximum.

For example, if the flow rate of the refrigerant in the refrigerant circuit is decreased because of a decrease in speed of the engine E, the downward force based on the pressure difference ΔPd between the two points decreases, and the electromagnetic force F, at this time, can not balance the forces acting on the rod 40. Therefore, the rod 40 moves upward, which compresses the first spring 50. The valve body 43 of the rod 40 is positioned such that the increase in the downward force f1 of the first spring 50 compensates for the decrease in the downward force between on the pressure difference ΔPd between the two points. As a result, the opening of the communication passage 47 is reduced and the crank pressure Pc is decreased. As a result, the difference between the crank pressure Pc and the pressure in the cylinder bores 1*a* is reduced, the inclination angle of the swash plate 12 is increased, and the discharge displacement of the compressor is increased. The increase in the discharge displacement of the compressor increases the flow rate of the refrigerant in the refrigerant circuit to increase the pressure difference ΔPd between the two points.

In contrast, when the flow rate of the refrigerant in the refrigerant circuit is increased because of an increase in speed of the engine E, the downward force based on the pressure difference ΔPd between the two points increases and the electromagnetic force F, at this time, can not balance the forces acting on the rod 40. Therefore, the rod 40 moves downward, which expands the first spring 50. The valve body 43 of the rod 40 is positioned such that the decrease in the downward force f1 of the first spring 50 compensates for the increase in the downward force based on the pressure difference ΔPd between the two points. As a result, the opening of the communication passage 47 is increased, the crank pressure Pc is increased, and the difference between the crank pressure Pc and the pressure in the cylinder bores 1*a* is increased. Accordingly, the inclination angle of the swash plate 12 is decreased, and the discharge displacement of the compressor is also decreased. The decrease in the discharge displacement of the compressor decreases the flow rate of the refrigerant in the refrigerant circuit, which decreases the pressure difference ΔPd between the two points.

When the duty ratio Dt of the electric current supplied to the coil 67 is increased to increase the electromagnetic force F, the pressure difference ΔPd between the two points can not balance the forces on the rod 40. Therefore, the rod 40 moves upward so that the first spring 50 is corresponded. The valve body 43 of the rod 40 is such that the increase in the downward force f1 of the first spring 50 compensates for the increase in the upward electromagnetic force F. As a result, the opening of the communication passage 47 is reduced and the discharge displacement of the compressor is increased. Accordingly, the flow rate of the refrigerant in the refrigerant circuit is increased to increase the pressure difference ΔPd between the two points.

In contrast, when the duty ratio Dt of the electric current supplied to the coil 67 is decreased, which decreases the electromagnetic force F, the pressure difference ΔPd between the two points at this time can not balance of the forces acting on the rod 40. Therefore, the rod 40 moves downward, which decreases the downward force f1 of the first spring 50. The valve body 43 of the rod 40 is positioned such that the decrease in the force f1 of the first spring 50 compensates for the decrease in the upward electromagnetic force F. As a result, the opening of the communication passage 47 is increased and the discharge displacement of the compressor is decreased. Accordingly, the flow rate of the refrigerant in the refrigerant circuit is decreased, which decreases the pressure difference ΔPd between the two points.

As described above, in the control valve CV, when an electric current that exceeds the minimum duty ratio Dt(min) is supplied to the coil 67, the rod 40 is positioned in accordance with the change in the pressure difference ΔPd between the two points to maintain a target value of the pressure difference ΔPd that is determined in accordance with the electromagnetic force F. By changing the electromagnetic force F, the target pressure difference can be varied between a minimum value, which corresponds to the minimum duty ratio Dt(min), and a maximum value, which corresponds to the maximum duty ratio Dt(max).

As shown in FIGS. 2 and 3, the vehicle air conditioner is provided with a controller 70. The controller 70 is a computer control unit including a CPU, a ROM, a RAM, and an I/O interface. An external information detector 72 is connected to the input terminal of the I/O interface. A drive circuit 71 is connected to the output terminal of the I/O interface.

The controller 70 performs an arithmetic operation to determine a proper duty ratio Dt on the basis of various pieces of external information, which is detected by the external information detector 72, and instructs the drive circuit 71 to output a drive signal corresponding to the duty ratio Dt. The drive circuit 71 outputs the drive signal of the instructed duty ratio Dt to the coil 67. The electromagnetic force F by the solenoid 60 of the control valve CV varies in accordance with the duty ratio Dt of the drive signal supplied to the coil 67.

Sensors of the external information detector 72 include, e.g., an A/C switch (ON/OFF switch of the air conditioner operated by the passenger or the like) 73, a temperature sensor 74 for detecting an in-vehicle temperature Te(t), and a temperature setting unit 75 for setting a desired target value Te(set) of the in-vehicle temperature.

Figure 6:
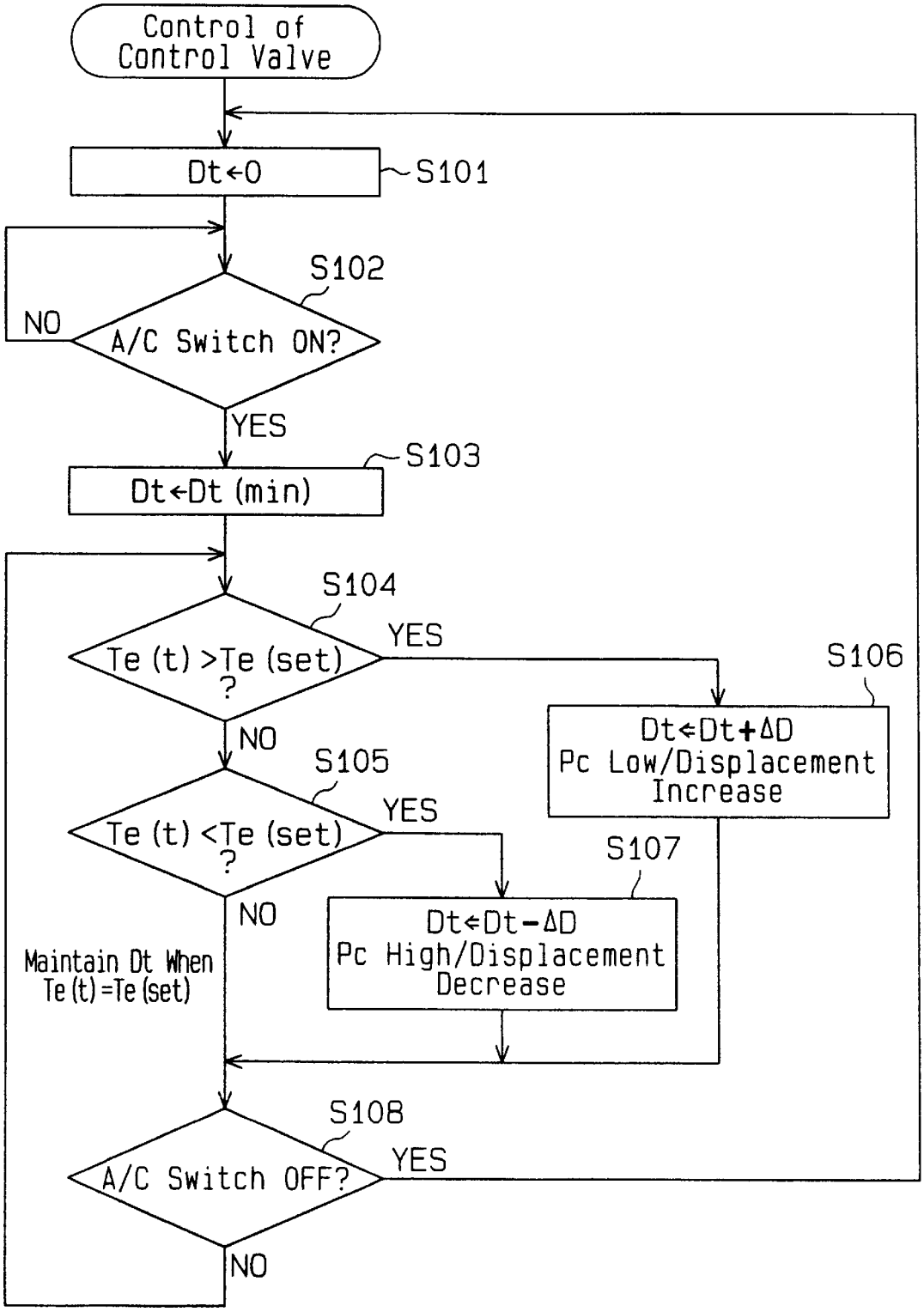
FIG. 6 is a flowchart of a control operation for the control valve.

Next, the duty control of the control valve CV by the controller 70 will be described with reference to the flowchart of FIG. 6.

When the ignition switch (or the start switch) of the vehicle is turned on, the controller 70 is supplied with an electric current to start processing. In step S101, the controller 70 makes various initializations. For example, the controller 70 sets an initial duty ratio Dt of zero. After this, condition monitoring and internal processing of the duty ratio Dt are performed.

In step S102, the controller 70 monitors the ON/OFF state of the A/C switch 73 until the switch 73 is turned on. When the A/C switch 73 is turned on, in step S103, the controller 70 sets the duty ratio Dt of the control valve CV to the minimum duty ratio Dt(min) and starts the internal self-control function (target pressure difference maintenance) of the control valve CV.

In step S104, the controller 70 judges whether the detected temperature Te(t) by the temperature sensor 74 is higher than the target temperature Te(set). If step S104 is negative, in step S105, the controller 70 further judges whether the detected temperature Te(t) is lower than the target temperature Te(set). When step S105 is negative, then the detected temperature Te(t) is equal to the target temperature Te(set). Therefore, the duty ratio Dt need not be changed. Thus, the controller 70 does not instruct the drive circuit 71 to change the duty ratio Dt and step S108 is performed.

If step S104 is positive, the interior of the vehicle is hot and the thermal load is high. Therefore, in step S106, the controller 70 increases the duty ratio Dt by a unit quantity ΔD and instructs the drive circuit 71 to increment the duty ratio Dt to a new value (Dt+ΔD) . As a result, the valve opening of the control valve CV is somewhat reduced, the discharge displacement of the compressor is increased, the ability of the evaporator 33 to transfer heat is increased, and the temperature Te(t) is lowered.

If step S105 is positive, the interior of the vehicle is relatively cool and the thermal load is low. Therefore, in step S107, the controller 70 decrements the duty ratio Dt by a unit quantity ΔD, and instructs the drive circuit 71 to change the duty ratio Dt to the new value (Dt−ΔD). As a result, the valve opening of the control valve CV is somewhat increased, the discharge displacement of the compressor is decreased, the ability of the evaporator 33 to transfer heat is reduced, and the temperature Te(t) is raised.

In step S108, it is judged whether or not the A/C switch 73 is turned off. If step S108 is negative, step S104 is performed. When step S108 is positive, step S101, in which the supply of the current to the control valve CV is stopped, is performed. Therefore, the valve opening of the control valve CV is fully opened, beyond the middle position, to rapidly increase the pressure in the crank chamber 5. As a result, in response t the A/C switch 73 being turned off, the discharge displacement of the compressor can be rapidly minimized. This shortens the period during which refrigerant unnecessarily flows in the refrigerant circuit. That is, unnecessary cooling is minimized.

Particularly in a clutchless type compressor, the compressor is always driven when the engine E is operated. For this reason, when cooling is unnecessary (when the A/C switch 73 is in the off state), it is required that the discharge displacement be minimized to minimize the power loss of the engine E. To satisfy this requirement, the control valve CV is effective since its valve opening can be opened beyond the middle position to positively minimize the discharge displacement.

As described above, by changing the duty ratio Dt in step S106 and/or S107, even when the detected temperature Te(t) deviates from the target temperature Te(set), the duty ratio Dt is gradually optimized and the detected temperature Te(t) converges to the vicinity of the target temperature Te(set).

This embodiment has the following advantageous.

Without using the suction pressure Ps, which is influenced by the thermal load in the evaporator 33, as a direct index opening for controlling the control valve CV, the pressure difference ΔPd between two pressure monitoring points P1 and P2 in the refrigerant circuit is used as a direct control object, and the discharge displacement of the compressor is feedback-controlled. Therefore, without being influenced by the thermal load on the evaporator 33, the displacement can be rapidly decreased by in accordance with an externally supplied electric current.

The first and second springs 50 and 66 and the first and second regulation surfaces 49 and 68 provide vibration resistance for the rod 40, the movable iron core 64, and the pressure sensing member 54 when the coil 67 is not supplied with electric current. Therefore, the movable member 40, 54, or 64 will not collide with a fixed surface (e.g., the valve housing 45 or the like) due to vibration of the vehicle, and this prevents valve damage.

In this embodiment, to ensure the vibration resistance of the movable members 40, 54, and 64, the first and second springs 50 and 66 and the first and second regulation surfaces 49 and 68 are provided. In this embodiment, the movable members 40, 54 are separated when the coil 67 is not supplied with electric current.

In a control valve in which the rod 40 is formed integrally with the pressure sensing member 54, which is referred to as the "comparative valve", if either the rod 40 or the pressure sensing member 54 is abutted against a regulation surface by a spring, the other of the rod 40 and the pressure sensing member 54 is indirectly pressed against the regulation surface. Therefore, only one spring and one regulation surface are provided.

As shown by a line made of long and short dashes in the graph of FIG. 5, however, a single spring in the comparative valve requires a heavy set load f' (f'=f1'+f2') that can press all the movable members 40, 54, and 64 against the regulation surface to vibration resistance. For the rod 40 to be fixed at an arbitrary position between the intermediate open state and the fully open state of the control valve CV, the spring of the comparative valve must have a large spring constant such that its characteristic line "f" slopes downward more than the characteristic line of the electromagnetic force F. More specifically, if the characteristic line "f" of the spring does not slope downward more than the characteristic line of the electromagnetic force F, the spring can not compensate for changes in the electromagnetic force F, even when the rod 40 moves (in other words, even when the compression of the spring changes). This also applies to the first spring 50 of the illustrated embodiment. In the control valve having an integral rod and pressure sensing member, the force acting in the control valve is given by the following equation (2):

$$PdH \cdot SA - PdL(SA - SB) = F - f \tag{2}$$

When the duty ratio Dt exceeds the minimum duty ratio Dt(min), electromagnetic force F exceeds the initial load f', which moves the rod 40 upward. As the rod 40 moves upward, the force f of the springs 50, 66 is increased, accordingly. To move the rod 40 upward against the increasing force f to the intermediatly open and to initiate the internal self-control comparative valve, the duty ratio Dt must be increased to the level Dt(1). As a result, in the range of the usable duty ratios Dt, the range to Dt(1) is used for starting the internal self-control function. As a result, using a duty ratio Dt within the range of Dt(1) to Dt(max) that is narrower than the duty ratio of this embodiment, the target pressure difference as a standard of the operation of the internal self-control function is changed. Thus the range of variation of the target pressure difference becomes narrower.

More specifically, in the comparative valve, only one spring is used for providing the vibration resistance of the movable members 40, 54 and for the internal self-control function based on the pressure difference ΔPd between the two points. Therefore, the force f applied to the rod 40 by the spring must be greater than the force f1+f2 of this embodiment. As a result, when the duty ratio Dt is maximized to Dt(max), the pressure difference ΔPd between the two points satisfying the equation (2) is small. This lowers the maximum target pressure difference, i.e., the controllable maximum flow rate in the refrigerant circuit.

In the comparative valve, assume that, to raise the maximum target pressure difference, the pressure sensing mechanism for the pressure difference ΔPd between the two points is modified to decrease the force applied to the rod 40 on the basis of the pressure difference ΔPd. For example, by reducing the cross sectional area SB of the distal end portion 41, the value of the left side of the equation (2) (PdH·SA−PdL(SA−SB)) is decreased. However, when the duty ratio Dt is at its minimum value Dt(1), the pressure difference ΔPd between the two points satisfying the equation (2) is large. This raises the minimum target pressure difference, i.e., the controllable minimum flow rate in the refrigerant circuit.

However, in the control valve CV of this embodiment, when the supply of electric current to the coil 67 is stopped, the movable members 40, 54 are separated, and the separated movable members 40, 54 are provided with the first and second urging springs 50 and 66 and the first and second regulation surfaces 49 and 68, respectively, for vibration resistance. The first spring 50 has a great spring constant that achieves the internal self-control function. The first spring 50 expands and contracts within the narrow range between the middle open state and the full open state (in other words, only within the range required for internal self-control function). On the other hand, the spring constant of the second spring 66, which must expand and contract within a wide range between the full open state and the closed state (in other words, within the range not required for the internal self-control function), is as low as possible.

As a result, while maintaining the vibration resistance of the movable members 40, 54, and 64, the force f1+f2 acting on the rod 40 is smaller than the force f of the comparative valve. Thus, using the duty ratio Dt within the wide range between Dt(min) and Dt(max), the target pressure difference can be changed in a wide range, i.e., the flow rate of the refrigerant in the refrigerant circuit can be controlled in a wide range.

Before valve body 43 contacts the pressure sensing member 54, the pressure sensing member 54 is pressed against the first regulation surface 49 by the first spring 50. That is, when there is no need for the position of the rod 40 to reflect the pressure difference ΔPd between the two points, the pressure sensing member 54 is stationary. Thus, the pressure sensing member 54 is never unnecessarily moved, unlike that of the comparative valve. Also, sliding between the pressure sensing member 54 and the inner wall surface of the pressure sensing chamber 48 is reduced. This improves the durability of the pressure sensing member 54 and the durability of the control valve CV.

In general, the compressor of the vehicle air conditioner is located in the narrow engine room of a vehicle. For this reason, the size of the compressor is limited. Therefore, the size of the control valve CV and the size of the solenoid 60 (the coil 67) are limited accordingly. Also, in general, the engine battery powers the solenoid 60 is used. The voltage of the vehicle battery is regulated to, e.g., 12 to 24 V.

In the comparative valve, when the maximum electromagnetic force F that the solenoid 60 is capable of generating is intended to be increased to widen the range of variation of the target pressure difference, increasing in size of the coil 67 and raising the voltage of the power supply are impossible, because either would entail considerable changes in existing systems and structures. In other words, if the control valve CV of the compressor uses an electromagnetic actuator as an external control device, this embodiment is most suitable for widening the range of variation of the target pressure difference.

When the pressure sensing member 54 contacts the first regulation surface 49 and the distal end portion 41 is separated from the pressure sensing member 54, the space 59 is defined by the bottom of the pressure sensing member 54 and the distal end portion 41. The space 59 communicates with the second pressure chamber 56 through the releasing groove 54*b*. Thus, refrigerant gas remaining in the space 59 does not adversely affect the positioning of the valve body 43. This allows the desired valve opening control.

For example, when the release groove 54*b* is not connected to the space 59, the refrigerant gas in the space 59 expands due to an increase in volume of the space 59. This expansion delays the movement of the rod 40 downward. As a result, contact of the rod 40 with the second regulation surface 68, i.e., full opening of the communication passage 47 by the valve body 43 is delayed.

Also, when the rod 40 contacts the pressure sensing member 54, the refrigerant gas in the space 59 is compressed due to the decrease in volume of the space 59. This compression delays movement of the rod 40. As a result, contact between the rod 40 and the pressure sensing member 54 is delayed, and the start of the internal self-control function is delayed.

Particularly, at the time the internal self-control function is started, the moment connected between the space 59 and the second pressure chamber 56, the pressure in the second pressure chamber 56 increases such that the gas in the space 59 that is at a high pressure since the above-described compression, Therefore, the pressure difference ΔPd which acts on the pressure sensing member 54 becomes small. As a result, the rod 40 moves upward more than required, and the valve body 43 reduces the size of the opening of the communication passage 47 more than required. This makes the discharge displacement of the compressor too high.

Figure 7:
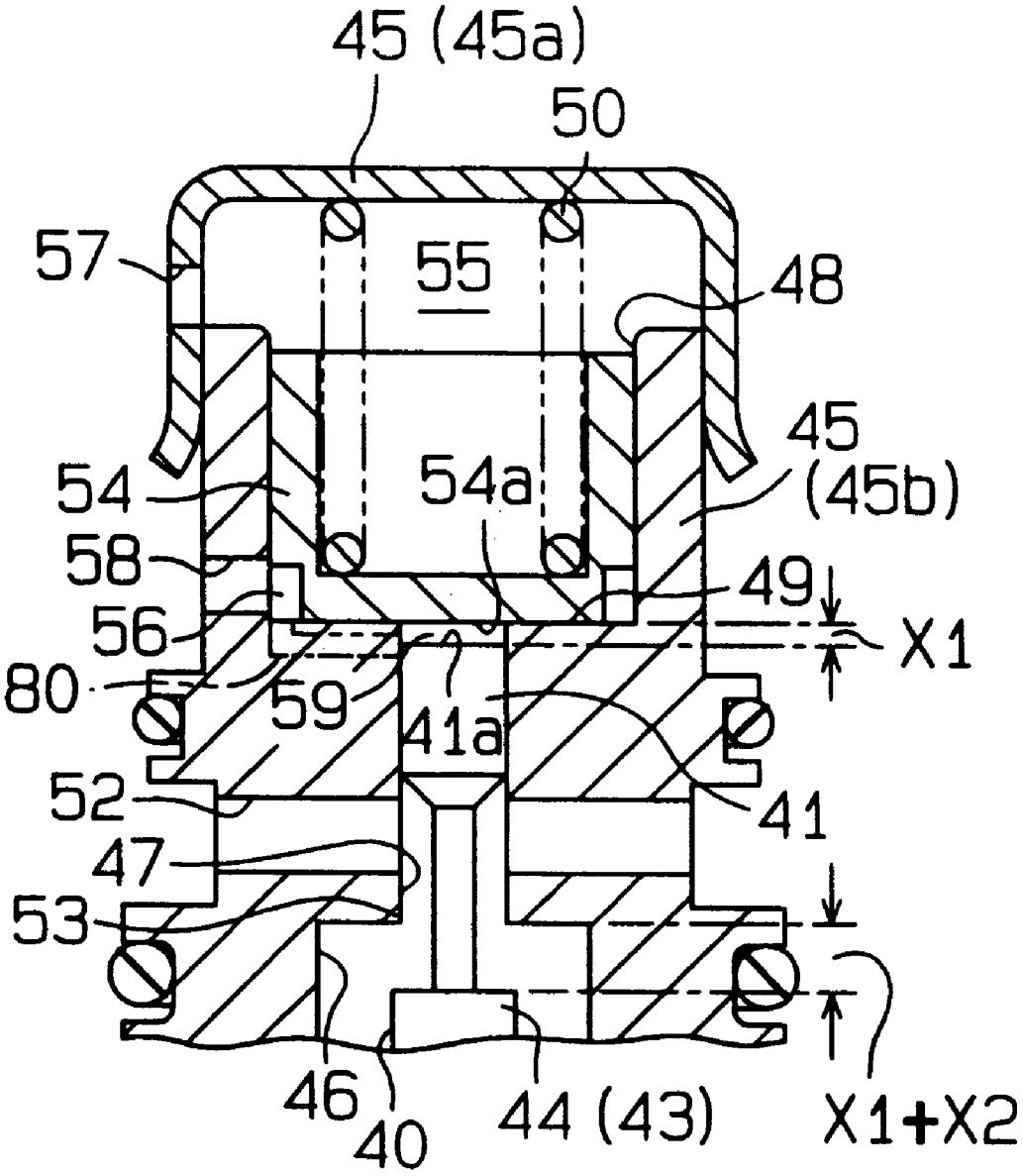
FIG. 7 is an enlarged partial sectional view of the control valve of second embodiment of the present invention when its operating rod is in the lowermost position.

The releasing groove 54*b* connects the space 59 and the second pressure chamber 56. This structure is simpler than a structure in which the space 59 is subjected to the pressure PdL with a passage bypassing the contact area between the pressure sensing member 54 and the first regulation surface 49 (e.g., a passage 80 according to broken lines in FIG. 7).

If the releasing groove 54*b* were formed in the first regulation surface 49 (the bottom surface of the pressure sensing chamber 48), a tool must be inserted in the small pressure sensing chamber 48 to form the groove. This is troublesome. However, in this embodiment, the releasing groove 54*b* is formed in the pressure sensing member 54, and the machining is relatively simple.

The first spring 50 urges the pressure sensing member 54 toward the second pressure chamber 56. That is, the direction in which the first spring 50 urges the pressure sensing member 54 is the same as the direction in which a pressing force based on the pressure difference ΔPd between the two points acts. Therefore, when the current is not supplied the coil 67, the pressure sensing member 54 is pressed against the first regulation surface 49 with a force based on of the spring 50 and the pressure difference ΔPd between the two points.

The control valve CV changes the pressure in the crank chamber 5 by so-called inlet valve control, in which the opening of the supply passage 28 is changed. Therefore, in comparison with outlet valve control, in which the opening of the bleed passage 27 is changed, the pressure in the crank chamber 5, i.e., the discharge displacement of the compressor, can be changed more rapidly.

The first and second pressure monitoring points P1 and P2 are located in the refrigerant circuit between the discharge chamber 22 of the compressor and the condenser 31. Therefore, the operation of the expansion valve 32 does not affect the detection of the discharge displacement of the compressor based on the pressure difference ΔPd between the two points.

The present invention may be modified as follows:

A releasing groove may be formed in the first regulation surface 49 (i.e., the bottom surface of the second pressure chamber 56). In this case, the groove can be used together with the releasing groove 54*b* of the above-described embodiment.

The releasing groove 54*b* may be eliminated from the above-described embodiment so that the contact area between the pressure sensing member 54 and the first regulation surface 49 cuts communication between the space 59 and the second pressure chamber 56. For example, as shown by broken lines in FIG. 7, a passage 80 may be formed in the upper half body 45*b* of the valve housing 45 so that the space 59 is subjected to the same pressure as the second pressure chamber 56 through the passage 80. The passage 80 may directly connect the fourth port 58 to the space 59. Alternatively, the passage 80 may directly connect the second pressure detecting passage 38 and the space 59. Alternatively, the passage 80 may directly connect the second pressure monitoring point P2 and the space 59.

The first pressure monitoring point P1 may be provided in the suction pressure zone between the evaporator 33 and the suction chamber 21, and the second pressure monitoring point P2 may be provided downstream of the first pressure monitoring point P1.

The first pressure monitoring point P1 may be provided in the discharge pressure zone between the discharge chamber 22 and the condenser 31, and the second pressure monitoring point P2 may be provided in the suction pressure zone between the evaporator 33 and the suction chamber 21.

The first pressure monitoring point P1 may be provided in the discharge pressure zone between the discharge chamber 22 and the condenser 31, and the second pressure monitoring point P2 may be provided in the crank chamber 5. Otherwise, the first pressure monitoring point P1 may be provided in the crank chamber 5, and the second pressure monitoring point P2 may be provided in the suction pressure zone between the evaporator 33 and the suction chamber 21. The locations of the pressure monitoring points P1 and P2 are not limited to the main circuit of the cooling circuit, i.e., the evaporator 33, the suction chamber 21, the cylinder bores 1*a*, the discharge chamber 22, or the condenser 31. That is, the pressure monitoring points P1 and P2 need not be in a high pressure region or a low pressure region of the refrigerant circuit. For example, the pressure monitoring points P1 and P2 may be located in a refrigerant passage for displacement control that is a subcircuit of the cooling circuit, i.e., a passage formed by the crank chamber 5 in a middle pressure zone of the supply passage 28, the crank chamber 5, and the bleed passage 27.

The control valve may be a so-called outlet control valve for controlling the crank pressure Pc by controlling the opening of the bleed passage 27.

When the electromagnetic force F is increased, the valve opening size of the control valve CV may be increased and the target pressure difference may be decreased.

The second spring 66 may be accommodated not in the solenoid chamber 63 but in the valve chamber 46.

The present invention can be applied to a controller of a wobble type variable displacement compressor.

The present invention can be used in compressor having a power transmission mechanism PT with a clutch mechanism such as an electromagnetic clutch.

There are compressors that minimize the displacement to reduce the power loss of the connected vehicle engine when the vehicle is suddenly accelerated. To effectively reduce the power loss, the displacement need be minimized quickly. The control valve CV of the illustrated embodiment is suitable for such compressors since the opening size of the control valve CV can be greater than the intermediately open state, at which the displacement is minimum.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor in a refrigerant circuit, wherein the compressor changes the displacement in accordance with the pressure in a crank chamber and includes a supply passage, which connects a discharge pressure zone to the crank chamber, and a bleed passage, which connects a suction pressure zone to the crank chamber, the control valve comprising:

a valve housing;

a valve chamber defined in the valve housing, wherein the valve chamber is part of the supply passage or the bleed passage;

a movable valve body located in the valve chamber, wherein the valve body adjusts an opening size of the supply passage or the bleed passage in the valve chamber;

a valve body regulator for regulating the movement of the valve body;

a first urging member for urging the valve body towards the valve body regulator;

a sensing chamber defined in the valve housing;

a sensing member located in the sensing chamber to divide the sensing chamber into a first pressure chamber and a second pressure chamber, wherein the sensing member engages with and disengages from the valve body, wherein the pressure of a first pressure monitoring point located in the refrigerant circuit is applied to the first pressure chamber, and the pressure of a second pressure monitoring point located in the refrigerant circuit is applied to the second pressure chamber, and the sensing member moves in accordance with the pressure difference between the first pressure chamber and the second pressure chamber;

a sensing member regulator for regulating the movement of the sensing member, wherein the sensing member regulator is located in the second pressure chamber, and a temporary chamber is formed between the sensing member and the valve body when the valve body is disconnected from the sensing member, and the temporary chamber is connected to the second pressure chamber;

a second urging member for urging the sensing member toward the sensing member regulator; and an actuator for applying a force to the valve body that is opposite to the force of the first urging member and that of the second urging member in accordance with commands from an external controller, wherein the actuator changes a target pressure difference, which is a reference value for the operation of the sensing member.

2. The control valve according to claim 1, wherein a groove that connects the temporary chamber and the second pressure chamber is formed in the sensing member.

3. The control valve according to claim 1, wherein a passage that connects the temporary chamber and the second pressure chamber is formed in the valve housing.

4. The control valve according to claim 1, wherein the first urging member is a spring and the second urging member is a spring, and the spring constant of the first urging member is smaller than that of the second urging member.

5. The control valve according to claim 1, wherein the refrigerant circuit has a condenser, wherein the first and the second pressure monitoring points are located in a section of the refrigerant circuit between the discharge pressure zone and the condenser.

6. The control valve according to claim 1, wherein the second urging member presses the sensing member toward the sensing member regulator until the valve body contacts the sensing member.

7. A control valve used for a variable displacement compressor in a refrigerant circuit, wherein the compressor changes the displacement in accordance with the pressure in a crank chamber and includes a supply passage, which connects a discharge pressure zone to the crank chamber, and a bleed passage, which connects a suction pressure zone to the crank chamber, the control valve comprising:

a valve housing;

a valve chamber defined in the valve housing, wherein the valve chamber is part of the supply passage or the bleed passage;

a movable valve body located in the valve chamber, wherein the valve body adjusts an opening size of the supply passage or the bleed passage in the valve chamber;

a valve body regulator for regulating the movement of the valve body;

a first urging member for urging the valve body towards the valve body regulator;

a sensing chamber defined in the valve housing;

a sensing member located in the sensing chamber to divide the sensing chamber into a first pressure chamber and a second pressure chamber, wherein the sensing member engages with and disengages from the valve body, wherein the pressure of a first pressure monitoring point located in the refrigerant circuit is applied to the first pressure chamber, and the pressure of a second pressure monitoring point located in the refrigerant circuit is applied to the second pressure chamber, and the sensing member moves in accordance with the pressure difference between the first pressure chamber and the second pressure chamber;

a sensing member regulator for regulating the movement of the sensing member, wherein the sensing member regulator is located in the second pressure chamber, and a temporary chamber is formed between the sensing member and the valve body when the valve body is disconnected from the sensing member, and the pressure in the temporary chamber is the same as the pressure in the second pressure chamber;

a second urging member for urging the sensing member toward the sensing member regulator, wherein the direction in which the second urging member urges the sensing member is the same as the direction in which a force on the sensing member based on the pressure difference between the first pressure chamber and the second pressure chamber; and external control means for applying a force to the valve body that is opposite to the force of the first urging member and that of the second urging member in accordance with commands from an external controller, wherein the external control means change a target pressure difference, which is a reference value for the operation of the sensing member.

8. The control valve according to claim 7, wherein a groove that connects the temporary chamber and the second pressure chamber is formed in the sensing member.

9. The control valve according to claim 7, wherein a passage that connects the temporary chamber and the second pressure chamber is formed in the valve housing.

10. The control valve according to claim 7, wherein the first urging member is a spring and the second urging member is a spring, and the spring constant of the first urging member is smaller than that of the second urging member.

11. The control valve according to claim 7, wherein the refrigeration circuit has a condenser, wherein the first and the second pressure monitoring points are located in a section of the refrigeration circuit that includes the condenser.

12. The control valve according to claim 7, wherein the second urging member presses the sensing member toward the sensing member regulator until the valve body contacts the sensing member.

13. The control valve according to claim 7, wherein the external control means is an actuator.

* * * * *